US005196078A

United States Patent [19]

Pote

[11] Patent Number: 5,196,078

[45] Date of Patent: Mar. 23, 1993

[54] METHOD OF MAKING FLEXIBLE COAXIAL CABLE HAVING THREADED DIELECTRIC CORE

[75] Inventor: William T. Pote, Glen Gardner, N.J.

[73] Assignee: Flexco Microwave, Inc., Port Murray, N.J.

[21] Appl. No.: 727,458

[22] Filed: Jul. 9, 1991

[51] Int. Cl.[5] ..... H01B 13/22

[52] U.S. Cl. ..... 156/52; 29/828; 174/102 D; 174/106 D; 174/28

[58] Field of Search ..... 156/52, 294; 29/828; 174/21 C, 28, 102 D, 102 SC, 105 R, 106 D, 107

[56] References Cited

U.S. PATENT DOCUMENTS

| | | | |
|---|---|---|---|
| 3,711,621 | 1/1973 | Jachimowicz | 174/106 D X |
| 3,717,718 | 2/1973 | Schmidtchen | 174/106 D |
| 3,797,104 | 3/1974 | Pote | 174/106 D X |
| 4,259,990 | 4/1981 | Rohner | 174/28 X |
| 4,346,253 | 8/1982 | Saito et al. | 174/102 D X |
| 4,487,660 | 12/1984 | Netzel et al. | 174/21 C X |
| 4,758,685 | 7/1988 | Pote et al. | 174/28 X |
| 4,780,574 | 10/1988 | Neuroth | 174/102 D |
| 5,077,449 | 12/1991 | Cornibert et al. | 174/107 |

*Primary Examiner*—David A. Simmons
*Assistant Examiner*—Mark A. Osele
*Attorney, Agent, or Firm*—Bryan Cave

[57] ABSTRACT

A method for making a flexible coaxial cable (38) in which a threaded dielectric core (30) is threadably inserted into a flexible hollow outer conductor sheath (50) to lock the core (30) to the outer conductor (50). The outer diameter (d3) of the core (30) is larger than the inside diameter (d2) of the outer sheath (50) such that the peak-to-peak diameter (d3) of the core (30) is 2/1000 of an inch-5/1000 of an inch larger than the inside diameter (d2) of the conductive sheath (50). The outer conductive sheath (50) comprises a corrugated portion (52) having a plurality of peaks (54) and valleys (56) at a predetermined pitch ($P_1$) which may be the same or different than the pitch ($P_2$) of the threaded core (30) with the valleys (56) becoming sufficiently embedded in the core (30) during threading to lock the core (30) and sheath (50) together to provide electrical stability for the cable (38) without causing mechanical deformation of the sheath (50). The threadably locked cable (38) is preferably temperature cycled (60) to provide temperature stability for the locked electrically stable cable (30).

12 Claims, 1 Drawing Sheet

FIG. 1
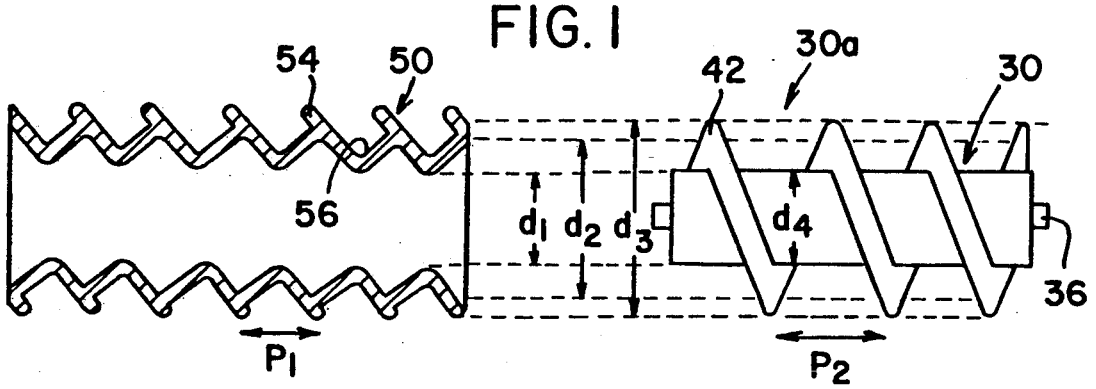
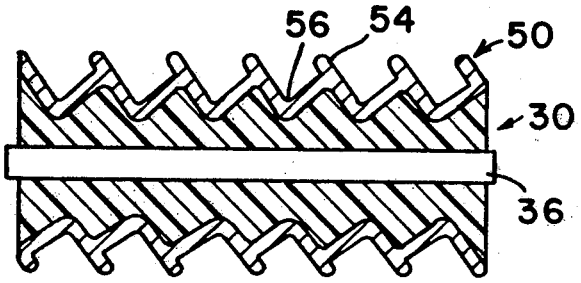
FIG. 2
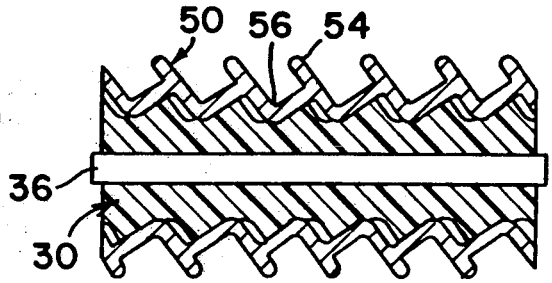
FIG. 3
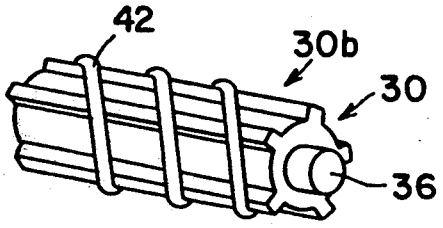
FIG. 4
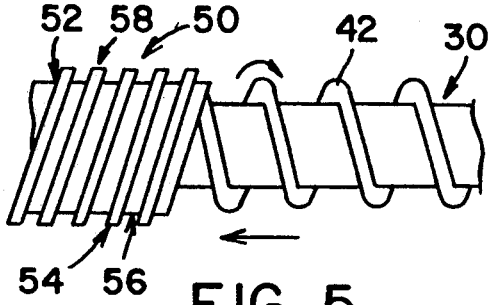
FIG. 5
FIG. 6
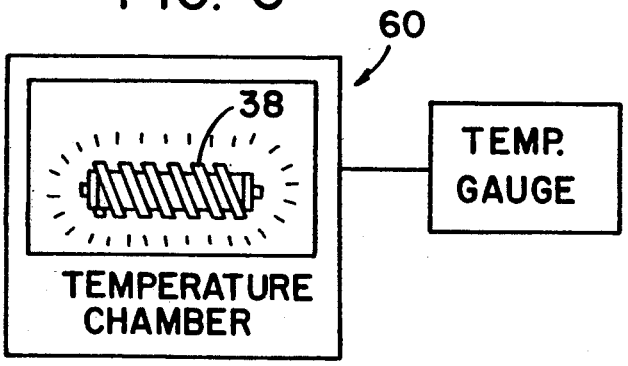

METHOD OF MAKING FLEXIBLE COAXIAL CABLE HAVING THREADED DIELECTRIC CORE

CROSS-REFERENCE TO RELATED APPLICATIONS

This application is related to commonly owned prior U.S. Pat. Nos. 3,797,104, naming William T. Pote as sole inventor, and U.S. Pat. No. 4,758,685 naming William T. Pote and Robert Landsman as joint inventors thererof, both of which are entitled "Flexible Coaxial Cable and Method of Making Same," and is an improvement thereon. This application is also related to the contemporaneously filed, commonly owned, copending U.S. patent application Ser. No. 749,194, filed Aug. 23, 1991, entitled "Improved Method of Making A Flexible Coaxial Cable and Resultant Cable," naming William T. Pote, Roger Johanson, and Thomas Pote as joint inventors thereof, the contents of which are specifically incorporated by reference herein in their entirety.

TECHNICAL FIELD

The present invention relates to improvements in the methods of making flexible coaxial cables.

BACKGROUND ART

Coaxial cables, such as for microwave transmission, have existed in the prior art for a considerable period of time. As technology has developed, a need for flexible coaxial cables whose electrical characteristics do not vary during flexure of the cable, such as in aerospace utilizations, has developed. In such utilizations, often the electrical characteristics of the cable are critical and any variation therein will yield unsatisfactory transmissions via such cables. In order to increase the flexibility of prior art coaxial cables, corrugated outer conductors, such as disclosed in U.S. Pat. Nos. 3,582,536; 3,173,990 and 2,890,263 have been utilized. In addition, other prior art attempts of providing such flexibility have employed a corrugated outer sheath for the cable rather than a corrugated outer conductor, such as disclosed in U.S. Pat. No. 3,002,047. Furthermore, this concept of a corrugated outer sheath has been utilized for standard electrical cables, as opposed to coaxial cables, where such cables are exposed to considerable flexure, such as disclosed in U.S. Pat. Nos. 2,348,641 and 2,995,616.

In order to ensure electrical stability for a coaxial cable, the relative location between the various portions of the outer conductor, the dielectric and the inner conductor must remain constant during flexure of the cable or the electrical characteristics may vary. Prior art attempts to ensure this stability have involved the locking of a corrugated outer conductor to the dielectric surrounding the inner conductor, such as disclosed in U.S. Pat. No. 3,173,990 wherein such inner conductor is a foam polyethylene. However, such prior art flexible coaxial cables do not have sufficient flexibility nor do they have sufficient temperature stability, which also affects the electrical characteristics. These prior art coaxial cables utilize either a tube which is crimped to provide a corrugated tube or form the outer conductor by means of helically winding a piece of conductive material, welding the adjacent pieces together to then form a tube and, thereafter, crimping alternate longitudinal portions so as to provide a corrugated tube. In both instances, the maximum pitch for the convolutions of the outer conductor is severly limited. In the first instance, this limitation is primarily due to rupture of the conductive tube if the crimps are too closely spaced together whereas, in the second instance, the limitations are primarily due to the inability to sufficiently control the thickness of the resultant tube which is formed as a thin enough material cannot be utilized to produce a high pitch. Since the higher the pitch of the convoluted outer conductor, the greater the flexiblity of the coaxial cable, these prior art flexible coaxial cables have not been satisfactory where large degrees of flexure are required together with electrical and temperature stability over a wide range of flexure.

Furthermore, these prior art flexible coaxial cables have primarily been of the foam polythylene or solid dielectric type whereas flexible coaxial cables utilizing spline dielectrics have not exhibited satisfactory electrical and temperature stability characteristics.

These disadvantages of the prior art have been overcome to an extent by the prior invention of U.S. Pat. No. 3,797,104 employing a solid dielectric. However, the ability to provide flexible coaxial cables for certain applications in which a particular velocity of propagation or lower attenuation was required was somewhat limited as was the ability to readily change the velocity of propagation of the flexible coaxial cable to the desired value during manufacture. Moreover, although there have been prior art attempts to use helically wound dielectrics for coaxial cable, such as disclosed in U.S. Pat. No. 4,346,253; French Patent No. 752,006 and British Patent No. 616,303, they have not been satisfactorily employed for flexible coaxial cables, particularly since any change in pitch of the helically wound dielectric during flexing of the cable wound undesirably change the properties of the cable. These disadvantages of the prior art have been overcome to some extent by the prior invention of U.S. Pat. No. 4,758,685 employing a heat shrinkable dielectric tubing surrounding a helically wound dielectric beading. However, the process of manufacturing such a flexible coaxial cable is difficult and necessarily can lend itself to instabilities, such as if the shrinking were non-uniform thereby resulting in a non-uniform dielectric core which could cause problems in inserting the core into the outer conductor, and resultant electrical instability due to the locking of a non-uniform core. Moreover, in locking the outer conductor to the dielectric core when forming a high frequency cable, whether using the arrangement disclosed in U.S. Pat. No. 3,797,104 or 4,758,685, if any deformation of the convolutions occurs during locking moding can result at the high frequencies transmitted over the resultant cable. Such moding is undesirable in that it eases deterioration in the transmission of the RF signal over the cable due to the high VSWR and attenuation which result. These disadvantages of the prior art are overcome by the present invention which provides a method in which the outer conductor may be readily locked to the dielectric core without any potential deformation of the convolutions which cause moding.

DISCLOSURE OF THE INVENTION

A method of making a flexible coaxial cable comprises the steps of providing a threaded dielectric core for the cable which is threadably insertable in a flexible hollow outer conductive sheath. The threaded core comprises an inner conductive member and a dielectric surrounding the inner conductive member which is located substantially along the longitudinal axis of the threaded dielectric. The threaded dielectric has a normal outermost radial extent about the longitudinal axis and has a predetermined pitch dependent on the desired electrical characteristics of the cable. The flexible hollow outer conductive sheath is substantially the same extent as the threaded core, and has a longitudinal axis coextensive with the threaded core longtiudinal axis and an innermost radial extent about the longitudinal axis which defines the innermost circumference of the hollow within the sheath. The threaded core threaded dielectric normal outermost radial extent is larger than the sheath innermost radial extent and has a predetermined peak-to-peak diameter sufficient to permit threadable insertion of the threaded core in the hollow outer conductive sheath, such as in the range of 2/1000 of an inch, which is 2 mils, to 5/1000 of an inch, which is 2 mils, larger than the inner most circumference of the hollow within the sheath. The flexible outer conductive sheath, which may be a convoluted type using a helically wound conductive strip or a corrugated type in which the flexible outer conductor is manufactured from a seamless or seamed tube, comprises a corrugated portion having a plurality of peaks and valleys of predetermined pitch and a helically wound conductive strip disposed about the peaks and having a pitch equivalent to the predetermined pitch. The pitch of the outer conductive sheath may be any desired pitch including the same pitch as that of the threaded dielectric core. In any event, the conductive strip portion is disposed on the peaks, with the valleys defining the sheath innermost radial extent, and with the peak disposed strip defining the sheath outermost radial extent. The core (which may be a threaded spline or any other type core is threadably inserted) into the flexible hollow outer conductive sheath until the sheath and the threaded core are substantially coextensive for threadably locking the threadably inserted dielectric to the sheath for providing a locked flexible coaxial cable due to such threadable insertion. In practicing the method of the present invention, the dielectric core may be threaded into the outer conductive sheath or the sheath may be threaded into the core without any discernible difference in result.

BRIEF DESCRIPTION OF THE DRAWINGS

FIGS. 1 and 5 are diagrammatic illustrations of the preferred method for threadably locking the inserted dielectric core to the convoluted outer conductor in accordance with the method of the present invention;

FIG. 2 is a cross sectional view of a preferred embodiment of a flexible coaxial cable produced by the method of the present invention, in which the threadable locking step of FIGS. 1 and 5 has been employed and the pitch of the cut dielectric core is the same as the pitch of the convoluted outer conductor;

FIG. 3 is a cross sectional view of a preferred embodiment of a flexible coaxial cable produced by the method of the present invention, in which the threadable locking step of FIGS. 1 and 5 has been employed and the pitch of the cut dielectric core is different from the pitch of the convoluted outer conductor;

FIG. 4 is a diagrammatic illustration of a typical helically wound spline type dielectric which may be employed in the method of the present invention in place of the helically wound dielectric core illustrated in FIGS. 1-3 and 5; and FIG. 6 is a diagrammatic illustration of the step of temperature cycling the flexible coaxial cable, threadably locked in accordance with the method of FIGS. 1-3, 5, between at least a pair of predetermined temperature extremes in accordance with the method of the present invention.

BEST MODE FOR CARRYING OUT THE INVENTION

Referrring now to the drawings in detail, and initally to FIGS. 1-5, a threaded dielectric core 30, such as one formed from Teflon, TFE, FEP or polyolefin by way of example, is preferably provided. This dielectric core 30, which preferably comprises an inner center conductor 36 secured thereto, such as by bonding during the extrusion process, may be formed in any manner, such as the manner disclosed in commonly owned U.S. Pat. No. 4,758,685 or the commonly owned contemporaneously filed U.S. patent application entitled "Improved Method of Making a Flexible Coaxial Cable, bearing U.S. Ser. No. 749,194, filed Aug. 23, 1991 and Resultant Cable". Moreover, the resultant threaded or spiral core 30 may be formed from any desired underlying shape, such as a spline **30*b* as shown in FIG. 4 by way of example, or from a cylindrical shape 30*a* such as shown in FIGS. 1-3 and 5 by way of example, or some other underlying shape, as long as there is a helical or spiral web or bead 42 which effectively wraps around the outside of the core 30** to form the threads which provide the locking to be described in greater detail hereinafter.

As shown and preferred in FIGS. 1-3 and 5, the threaded dielectric core 30, containing the inner conductor 36, is preferably threadably inserted into a flexible outer conductor, such as a convoluted outer conductor 50, such as one preferably composed of a corrugated main conductive member 52 which has been corrugated to produce peaks 54 and valleys 56 in the conductive member 50 at a predetermined pitch, such as the outer conductive member described in the commonly owned U.S. Pat. Nos. 3,797,104 and 4,758,685, or a corrugated type conductor in which the flexible outer conductor is manufactured from a seamless or seamed tube. As with that outer conductive member, a helically wound conductive strip 58 preferably composed of the same conductive material as the main conductive member 52, is preferably helically wound about the main conductive member 52 so as to have the strip wound conductor 58 be helically wound about the peaks 54 of the corrugated main conductive member 52. The conductive strip 58 is preferably secured to these peaks 54, such as by soldering, so as to form a single unitary composite conductive member, such as disclosed in U.S. Pat. Nos. 3,797,104 and 4,758,685, wherein the peaks 54 are accentuated by the helically wound strip 58 so as to increase the flexibility of the outer conductor 50.

With respect to the presently preferred threadable locking method illustrated in FIGS. 1-3 and 5, preferably the outermost diameter $d_3$ of the threaded dielectric core 30 is larger than the inside diameter $d_2$ of the convoluted outer conductor 50 with the peak-to-peak of the webs 42 which comprises the threads on the core 30 preferably being 2/1000 of an inch -5/1000 of an inch, which is 2 mils to 5 mils, larger than the inside diameter $d_2$ of the outer conductor 50. The threaded dielectric core 30 is then preferably threaded into the outer conductor 50, as shown in FIG. 5, or vice versa, which locks the core 30 and the outer conductor 50 together as shown in FIGS. 2 and 3, by way of example, with FIG. 2 illustrating the threadable locking of the core 30 to the outer conductor 50 when both have the same pitch ($P_1=P_2$), and with FIG. 3 illustrating the threadable locking of the core 30 to the outer conductor 50 when the pitch of the core 30 is different from the pitch of the outer conductor 50 ($P_1=P_2$). In either event, the threading of the core 30 and the outer conductor 50, enables the valleys 56 of the outer conductor 50 to thread into the core of 30 to produce at least a 2/1000 of an inch to 3/1000 of an inch lock without any deformation of the convolutions or valleys 56. thereby avoiding the type of distortions which can result in moding.

As shown and preferred in FIG. 6, after the core 30 is threadably locked to the outer conductors, the locked cable 38 is then preferably temperature cycled in a conventional temperature chamber 60 over a preferred temperature range, such as −60 degrees C. to +150 degrees C. for 48 hours, by way of example, to provide temperature stability for the locked cable 38.

Thus, by practicing the preferred method of the present invention, a dielectric core, which obtains the advantages of using a spiral or helical core, such as, disclosed in U.S. Pat. No. 4,758,685, may readily be locked to the cuter conductor for added electrical stability wihout encountering potential moding problems of the type which can normally occur with prior mechanical locking procedures.

What is claimed is:

1. A method of making a flexible coaxial cable comprising the steps of providing a threaded core for said cable, said threaded core comprising an inner conductive member and threaded dielectric means surrounding said inner conductive member, said inner conductive member being located substantially along the longitudinal axis of said threaded dielectric means, said threaded dielectric means having a normal outermost radial extent about said longitudinal axis and comprising a plurality of threads extending along said longitudinal axis and having a peak-to-peak diameter determined by said normal outermost radial extent, said threads having a predetermined pitch along said longitudinal axis dependent on the desired electrical characteristics of said cable; providing a flexible hollow outer conductive sheath of substantially the same extent as said threaded core, said sheath having a longitudinal axis coextensive with said threaded core longitudinal axis and an innermost radial extent about said longitudinal axis which defines the innermost circumference of said hollow within said sheath, said threaded core threaded dielectric means normal outermost radial extent being larger than said sheath innermost radial extent and having a predetermined peak-to-peak diameter sufficient to permit threadable insertion of said threaded core in said hollow outer conductive sheath, said sheath comprising a corrugated portion having a plurality of peaks and valleys of predetermined pitch and a conductive portion disposed about said peaks and having a pitch equivalent to said predetermined pitch, said conductive portion being conductively disposed on said peaks, said valleys defining said sheath innermost radial extent, said peak mounted conductive portion defining said sheath outermost radial extent; and threadably inserting said threaded core into said hollow outer conductive sheath until said sheath and said threaded core are substantially coextensive for threadably locking said threadably inserted dielectric means to said sheath for providing a locked flexible coaxial cable due to said threadable insertion.

2. A method in accordance with claim 1 wherein said threaded core comprises a threaded spline dielectric means surrounding said inner conductive member.

3. A method in accordance with claim 1 wherein said step of threadably inserting said threaded core into said hollow outer conductive sheath comprises the step of threading said sheath onto said threaded core.

4. A method in accordance with claim 3 wherein said predetermined pitch of said threaded dielectric means and said predetermined pitch of said sheath are the same.

5. A method in accordance with claim 4 wherein said predetermined peak-to-peak diameter of said threaded dielectric means is substantially in the range of 2/1000 of an inch to 5/1000 of an inch larger than said innermost circumference of said hollow within said sheath.

6. A method in accordance with claim 3 wherein said predetermined pitch of said threaded dielectric means and said predetermined pitch of said sheath are different.

7. A method in accordance with claim 6 wherein said predetermined peak-to-peak diameter of said threaded dielectric means is substantially in the range of 2/1000 of an inch to 5/1000 of an inch larger than said innermost circumference of said hollow within said sheath.

8. A method in accordance with claim 1 wherein said predetermined pitch of said threaded dielectric means and said predetermined pitch of said sheath are the same.

9. A method in accordance with claim 8 wherein said predetermined peak-to-peak diameter of said threaded dielectric means is substantially in the range of 2/1000 of an inch to 5/1000 of an inch larger than said innermost circumference of said hollow within said sheath.

10. A method in accordance with claim 1 wherein said predetermined pitch of said threaded dielectric means and said predetermined pitch of said sheath are different.

11. A method in accordance with claim 10 wherein said predetermined peak-to-peak diameter of said threaded dielectric means is substantially in the range of 2/1000 of an inch to 5/1000 of an inch larger than said innermost circumference of said hollow within said sheath.

12. A method in accordance with claim 1 wherein said predetermined peak-to-peak diameter of said threaded dielectric means is substantially in the range of 2/1000 of an inch to 5/1000 of an inch larger than said innermost circumference of said hollow within said sheath.

* * * * *